US008201285B1

(12) United States Patent
Pugliese et al.

(10) Patent No.: US 8,201,285 B1
(45) Date of Patent: Jun. 19, 2012

(54) INFLATABLE POOL COVERING SYSTEM AND ASSOCIATED METHOD

(76) Inventors: Gennaro Pugliese, Staten Island, NY (US); Domenic Pugliese, Staten Island, NY (US)

( * ) Notice: Subject to any disclaimer, the term of this patent is extended or adjusted under 35 U.S.C. 154(b) by 504 days.

(21) Appl. No.: 12/381,511

(22) Filed: Mar. 12, 2009

Related U.S. Application Data

(60) Provisional application No. 61/068,980, filed on Mar. 12, 2008.

(51) Int. Cl.
*E04H 4/00* (2006.01)

(52) U.S. Cl. ..... 4/499; 4/498; 4/503; 52/2.22; 52/2.23

(58) Field of Classification Search ..... 4/498, 499, 4/503; 52/2.22, 2.23
See application file for complete search history.

(56) References Cited

U.S. PATENT DOCUMENTS

| | | | | | |
|---|---|---|---|---|---|
| 2,914,776 | A * | 12/1959 | Hotz | 4/499 |
| 3,063,062 | A * | 11/1962 | Logan | 4/499 |
| 3,364,631 | A * | 1/1968 | Pleasants | 52/2.22 |
| 3,533,110 | A * | 10/1970 | Gisondi | 4/499 |
| 3,676,880 | A * | 7/1972 | Kwake | 4/499 |
| 3,747,131 | A * | 7/1973 | Koliomichalis | 4/499 |
| 4,048,678 | A * | 9/1977 | Chillino | 4/499 |
| 4,606,083 | A * | 8/1986 | Kingston | 4/580 |
| 4,825,479 | A * | 5/1989 | Bonneau | 4/499 |
| 4,847,925 | A * | 7/1989 | Perry | 4/499 |
| 5,144,704 | A * | 9/1992 | Genzel et al. | 4/499 |
| 5,373,590 | A * | 12/1994 | Svae et al. | 4/499 |
| 5,555,679 | A * | 9/1996 | Scherba | 52/2.18 |
| 5,901,503 | A * | 5/1999 | Dalene et al. | 52/2.11 |
| 6,286,157 | B1 * | 9/2001 | Baumann | 4/503 |
| 6,442,773 | B1 * | 9/2002 | Kopyar et al. | 4/498 |
| 6,606,752 | B2 * | 8/2003 | Marbach | 4/500 |
| 6,694,539 | B1 * | 2/2004 | Kordell et al. | 4/499 |
| 7,143,455 | B2 * | 12/2006 | Cordray et al. | 4/503 |
| 7,874,023 | B1 * | 1/2011 | Sundling | 4/499 |
| 2007/0199142 | A1 * | 8/2007 | Gray | 4/498 |
| 2010/0083436 | A1 * | 4/2010 | Wiegand | 4/499 |

* cited by examiner

*Primary Examiner* — Brian Glessner
*Assistant Examiner* — Joshua Ihezie

(57) ABSTRACT

The pool covering system provides an effective way of protecting a swimming pool from dirt and debris. The system includes an inflatable, dome shaped body and attached outer most layer configured to rest atop an existing swimming pool, repelling dirt, debris, water and snow, thus preventing this debris from collecting within the pool or on top of a liner. A bladder inflating mechanism is provided for selectively introducing air into the body such that the body maintains a dome shape and urges the fluid and debris away from the top surface of the pool. Passageways are provided inside the bladder for evenly distributing air therein and overcoming a weight of water and debris resting on the outer most layer.

8 Claims, 4 Drawing Sheets

INFLATABLE POOL COVERING SYSTEM AND ASSOCIATED METHOD

CROSS REFERENCE TO RELATED APPLICATIONS

This application claims the benefit of U.S. Provisional Application No. 61/068,980, filed Mar. 12, 2008 the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to pool covers and, more particularly, to an inflatable pool covering system for diverting debris and fluid away from the pool water.

2. Prior Art

A favorite summer activity enjoyed by millions of American consumers is going to a public or private swimming pool. A great way to beat the summer heat, spending time poolside can help ease the stresses of daily life, leaving one tanned, relaxed and well rested. For children, aquatic activities are especially popular and long hours are spent splashing in the water and playing spirited games of "water tag" and "Marco Polo" with family and friends. Because swimming, playing or simply relaxing by a pool is such an enjoyable way in which to spend free time, many consumers opt to have an in-ground or aboveground swimming pool installed right in their own backyard.

In fact, according to the National Pool and Spa Institute, nearly fifteen million households boast a residential swimming pool. Why are residential swimming pools so popular? Perhaps it is because they enable consumers to enjoy a variety of aquatic activities without ever leaving their home. A practical alternative to transporting a carload full of kids, water toys, snacks, towels and similar amenities to a local swimming pool, only to find that the pool is overcrowded with users, or in worse case scenario, closed to the public, owning a residential swimming pool allows consumers to step outside their back door and enjoy a quick swim, whenever desired. Additionally, considering that the cost of constructing a swimming pool, particularly aboveground pools, is very reasonable, and many consumers find that installing a residential swimming pool in their backyards is an affordable endeavor.

While there is little dispute that residential swimming pools provide consumers hours of summertime fun, there use is not without drawbacks. During the "off" seasons of autumn, winter and early spring, most swimming pool owners cover their pool with a thick plastic liner 16. Plastic pool liner 16*s* are practical in that they prevent leaves, branches, snow and rain water from entering the pool, creating a soupy mess and damaging the interior and operational mechanics of the pool.

Unfortunately, because of their very function, removing a pool liner 16 at the start of a summer season can be extremely difficult. As many pool owners would attest, attempting to pull a liner 16, loaded with broken twigs, soggy leaves, particles of paper and similar debris and which is heavily weighted with gallons of rainwater and melted snow, without spilling the contents of the liner 16 into the swimming pool, can be nearly impossible. Requiring the awkward removal of this debris before the liner 16 can be lifted from the pool, preparing a swimming pool for summertime use can be an extreme hassle.

Accordingly, the present invention is disclosed in order to overcome the above noted shortcomings. The pool covering system is convenient and easy to use, lightweight yet durable in design, and designed for preventing debris from collecting within the pool or on top of a standard liner 16.

BRIEF SUMMARY OF THE INVENTION

In view of the foregoing background, it is therefore an object of the present invention to provide an inflatable pool covering system for diverting debris and fluid away from the pool water. These and other objects, features, and advantages of the invention are provided by a protective pool covering system including an inflatable body adapted to be removably positioned over the entire top surface of the pool. Such a body preferably includes a top most layer formed from water impermeable material and spans over an entire surface area of the body. The top most layer may further have a flexible lip continuously extending along an entire outer perimeter of the body such that the lip is adapted to be continuously abutted along an entire outer perimeter of the pool.

The body further includes an inflatable bladder formed from buoyant material. The inflatable bladder may be statically connected to the top most layer and situated therebeneath. A body inflating mechanism is also provided, which selectively inflates the body with air such that the bladder and the top most layer are simultaneously inflated to a dome shape when the body is adapted to an inflated position.

In a preferred embodiment, the body may be formed from buoyant material and adapted to float on the top surface of the pool while disposed at the inflated position.

The lip preferably includes a plurality of fasteners spaced along an entire circumference thereof for maintaining the top most layer and the bladder at a substantially stable position during extended periods of time. Such fastening members may be removably affixed to an external support surface to prohibit the body from prematurely fraying or peeling away from the perimeter of the pool structure.

A bottom-most region of the bladder may be adapted to directly float on the top surface of the pool while a top-most region of the bladder remains elevated and thereby defines an apex of the bladder. In this manner, a downwardly sloping plane is defined from a center of the body and directs the fluid and debris towards the lip of the body.

In a preferred embodiment, the body inflating mechanism preferably includes an air valve directly connected to the top most layer and the bladder respectively. Such an air valve has a central orifice formed therein and passing through to an interior of the bladder. The mechanism further includes an air pump communicatively coupled to the air valve, a user interface communicatively coupled to the air pump, and a power source communicatively coupled to the user interface. Such an air pump may be selectively adapted between alternate operating modes upon receiving a user input signal from the user interface.

In one embodiment, the bladder preferably includes a main cavity for receiving and holding air during when adapted to the inflated position. Such a bladder further includes a plurality of walls located inside the main cavity. The walls are preferably configured in such a manner that a plurality of passageways are formed within the main cavity. Advantageously, each of the passageways are in fluid communication with the main cavity such that air is selectively distributed through an entire surface area of the cavity after entering the bladder through the air valve.

In particular, a first one of the passageways has a proximal end directly mated to the air valve. Such a first passageway spans along an entire diameter of the bladder and is provided with a plurality of apertures channeling air towards the bottom and top regions of the bladder. A second one of the passageways preferably has a proximal end directly mated to the bottom-most region of the bladder. The second passageway spans upwardly from the bottom-most region and traverses the first passageway such that the second passageway terminates at the apex of the bladder. The second passageway is also provided with a plurality of apertures that channel air towards and away from the air valve.

Notably, the first and second passageways are in fluid communication with each other and the air valve respectively for evenly distributing air throughout the entire main cavity during inflating procedures.

The present invention further includes a method of utilizing a protective pool covering system for diverting undesirable debris and fluid away from a top surface of a pool. Such a method preferably includes the chronological steps of: providing and removably positioning an inflatable body over the entire top surface of the pool. The body includes a top most layer formed from water impermeable material and spans over an entire surface area of the body. The top most layer further has a flexible lip continuously extending along an entire outer perimeter of the body such that the lip is adapted to be continuously abutted along an entire outer perimeter of the pool. An inflatable bladder is formed from buoyant material and statically connected to the top most layer and situated therebeneath. Thus, the body is formed from buoyant material and adapted to float on the top surface of the pool while disposed at the inflated position.

The method may further include the step of selectively inflating the body with air such that the bladder and the top most layer are simultaneously inflated to a dome shape when the body is adapted to an inflated position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
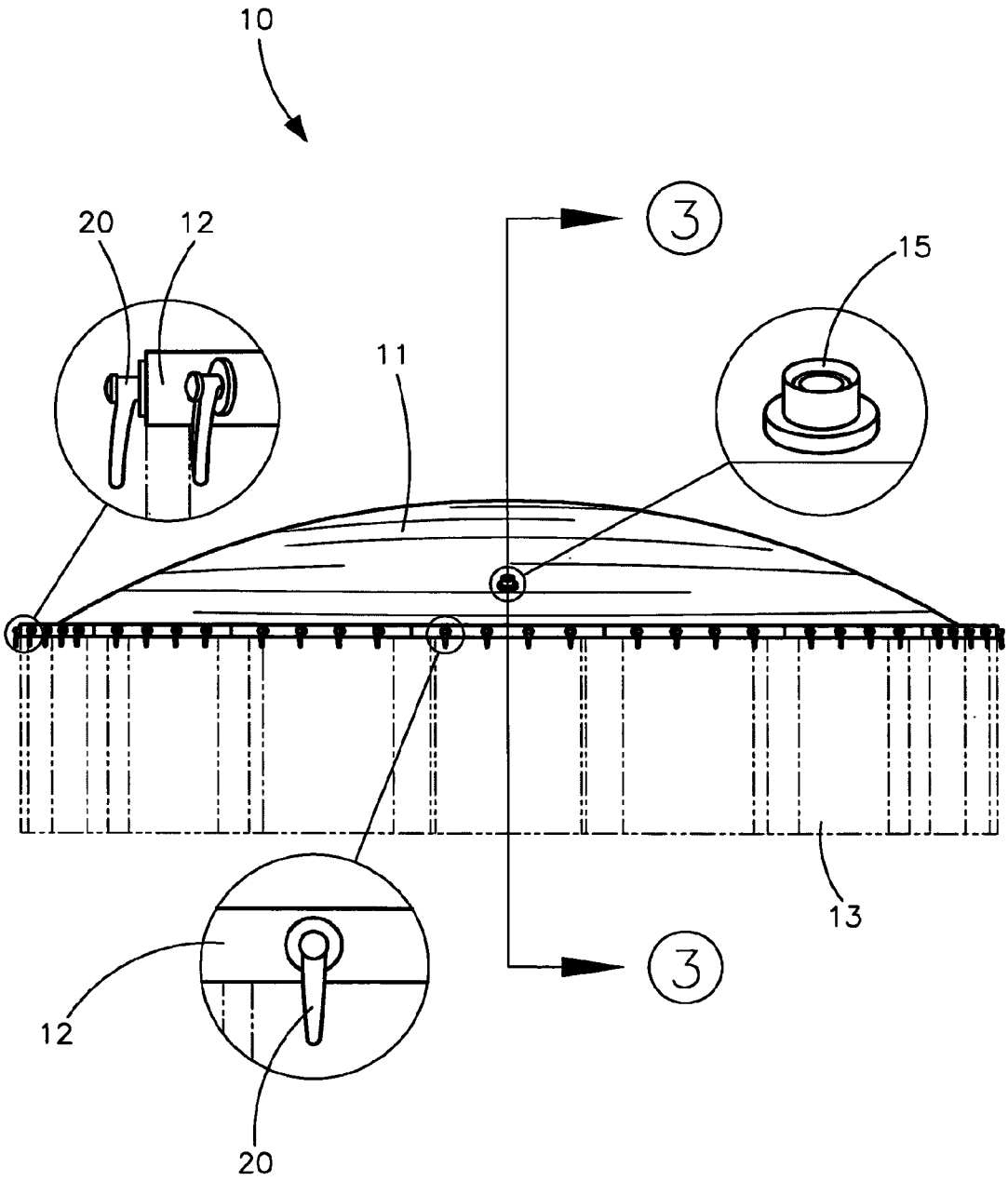
FIG. 1 is a front elevational view of an inflatable pool covering system, in accordance with the present invention.
Figure 2:
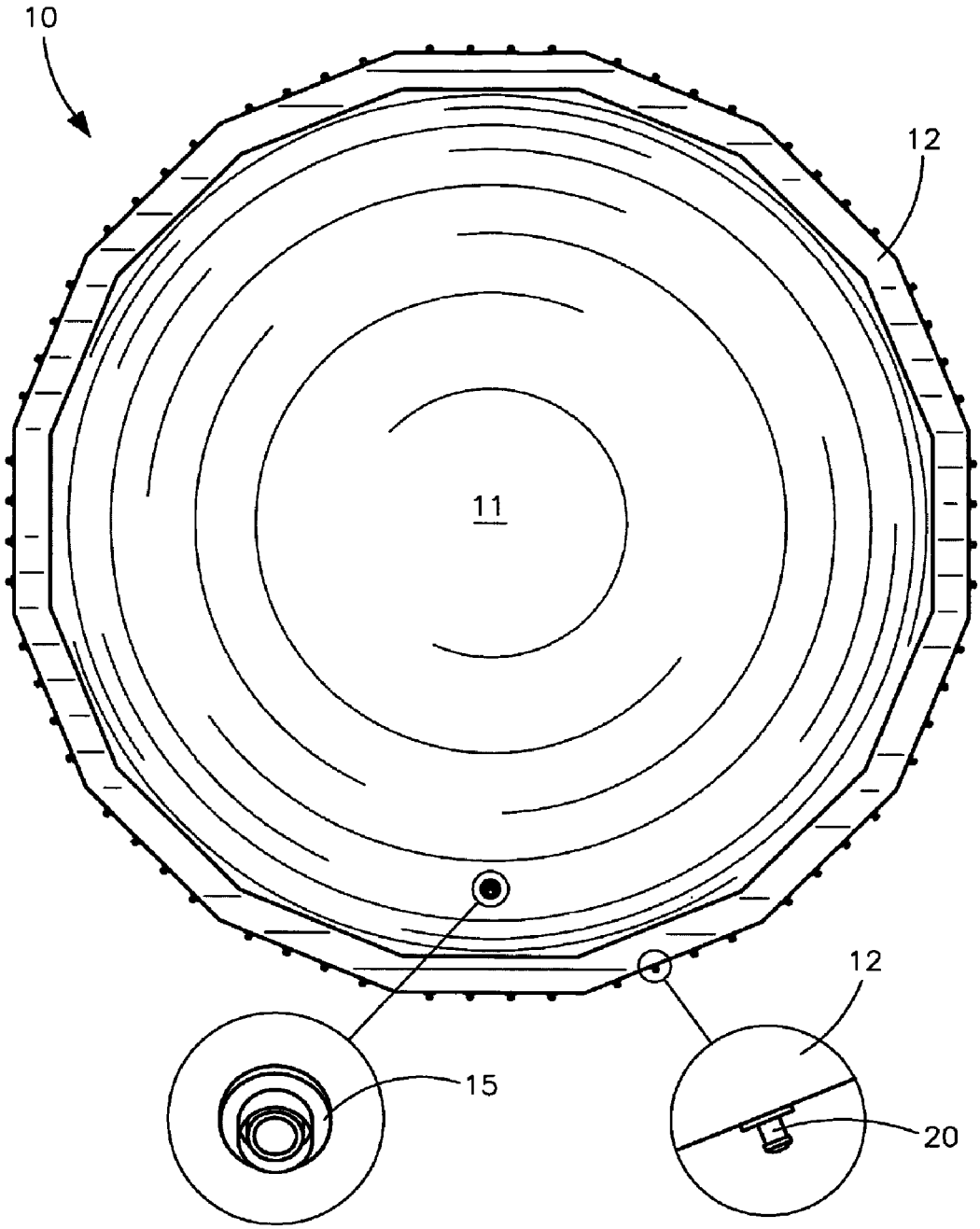
FIG. 2 is a top plan view of the inflatable pool covering system shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

The system 10 of this invention is referred to generally in the figures and is intended to provide a pool covering system. It should be understood that the system 10 may be used to cover many different types of pools and should not be limited to use with only those types of pools mentioned herein.

Referring to the figures in general, the system 10 provides an effective way of protecting a swimming pool 13 from dirt and debris. The system includes an inflatable, dome-like tarp (body 11) and attached liner (outer most layer 16), configured to rest atop an existing swimming pool 13, repelling dirt, debris, water and snow, thus preventing this debris from collecting within the pool 13 or on top of the outer most layer 16.

In this manner, the pool covering system 10 serves as an umbrella for shielding the pool 13 from harsh seasonal elements. Manufactured of heavy duty yet lightweight plastic material, the system would be produced in a variety of sizes and shapes appropriate for use with various aboveground and in-ground swimming pools. Considerations for this product could include circular, rectangle, kidney and oval shaped units, produced in a range of sizes to accommodate pools of varying dimensions.

In one embodiment, a round body 11 sized appropriately to accommodate various shaped pools is presented. The inflatable portion 17 of the body 11 may be centrally positioned and encompass the majority of the body 11.

In one embodiment, the fastening members 20 may include a series of circular shaped grommets evenly spaced along the lip 12 and are designed to be utilized in conjunction with existing tethers or cords for use in securing the outer most layer 16 to the side of the pool 13.

Positioned near the outer edge of the body 11 may be an air valve 15 to be utilized in conjunction with a manual or electrically operated air pump 31, thus enabling the user to easily inflate the bladder 17. Any conventional air pump 31 may be utilized to inflate the body 11.

The system 10 is simple to use, inexpensive, and designed for many years of repeated use. The pool covering system 10 is a practical product invention which would provide consumers a number of significant benefits and advantages. Foremost, the system 10 would offer a simple and efficient way of preventing debris from collecting in their pool 13 during the winter months. Completely encompassing and shrouding the top of the pool 13, use of the body 11 would ensure that the pool 13 remained clean and free of debris.

The present invention 10 may also spare the hassle of chasing away birds and other small creatures from the top of the body 11, as well as scraping leaves, dirt, twigs, branches and similar debris off the top of their pool liner 16. Further, because use of this product would also prevent heavy rainwater, melted snow and sleet from collecting on the top of the outer most layer 16, the pool covering system 10 would enable consumers to remove body 11 in a quick and easy manner.

Eliminating the frustrating scenario of removing a soiled pool liner 16, only to have the contents of the liner 16 spill into the clean swimming pool 13, the system 10 could make the task of readying the pool 13 for summer use far less taxing. Ideal for use with both aboveground and in-ground swimming pools, the system 10 is a versatile product which would serve a variety of useful applications. Simple to install and easily inflated with a standard air pump 31, consumers should appreciate the ease at which this product could be utilized.

Referring to FIGS. 1-4 in general, the present invention discloses a protective pool covering system 10 including an inflatable body 11 adapted to be removably positioned over the entire top surface of the pool 13. Such a body 11 preferably includes a top most layer 16 formed from water impermeable material and spans over an entire surface area of the body 11. The top most layer 16 may further have a flexible lip 12 continuously extending along an entire outer perimeter of the body 11 such that the lip 12 is adapted to be continuously abutted along an entire outer perimeter of the pool 13.

The body 11 further includes an inflatable bladder 17 formed from buoyant material. The inflatable bladder 17 may be statically connected to the top most layer 16 and situated therebeneath. A body inflating mechanism 30 is also provided, which selectively inflates the body 11 with air such that the bladder 17 and the top most layer 16 are simultaneously inflated to a dome shape when the body 11 is adapted to an inflated position.

In a preferred embodiment, the body 11 may be formed from buoyant material and adapted to float on the top surface of the pool 13 while disposed at the inflated position.

The lip 12 preferably includes a plurality of fasteners spaced along an entire circumference thereof for maintaining the top most layer 16 and the bladder 17 at a substantially stable position during extended periods of time. Such fastening members 20 may be removably affixed to an external support surface to prohibit the body 11 from prematurely fraying or peeling away from the perimeter of the pool structure. The fastening members may include snap-on buttons, for example.

A bottom-most region 18 of the bladder 17 may be adapted to directly float on the top surface of the pool 13 while a top-most region 19 of the bladder 17 remains elevated and thereby defines an apex 21 of the bladder 17. In this manner, a downwardly sloping plane is defined from a center of the body 11 and directs the fluid and debris towards the lip 12 of the body 11.

In a preferred embodiment, the body 11 inflating mechanism 30 preferably includes an air valve 15 directly connected to the top most layer 16 and the bladder 17 respectively. Such an air valve 15 has a central orifice 42 formed therein and passing through to an interior of the bladder 17. The mechanism 30 further includes an air pump 31 communicatively coupled to the air valve 15, a user interface 33 is communicatively coupled to the air pump 31, and a power source 32 is communicatively coupled to the user interface 33. Such an air pump 31 may be selectively adapted between alternate operating modes upon receiving a user input signal from the user interface 33.

Figure 3:
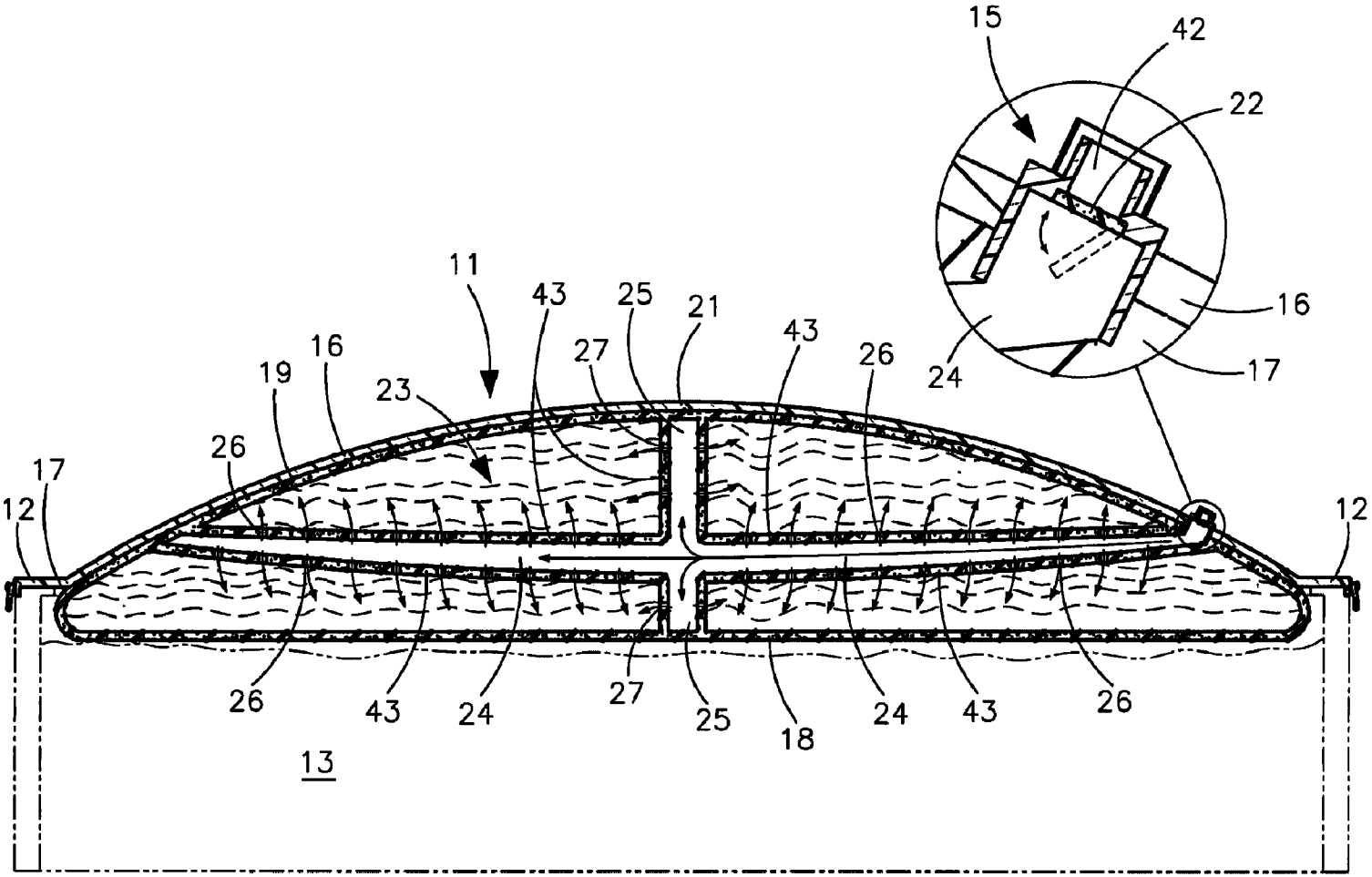
FIG. 3 is a cross-sectional view taken along line 3-3 in FIG. 1, showing the bladder adapted to an inflated position.
Figure 4:
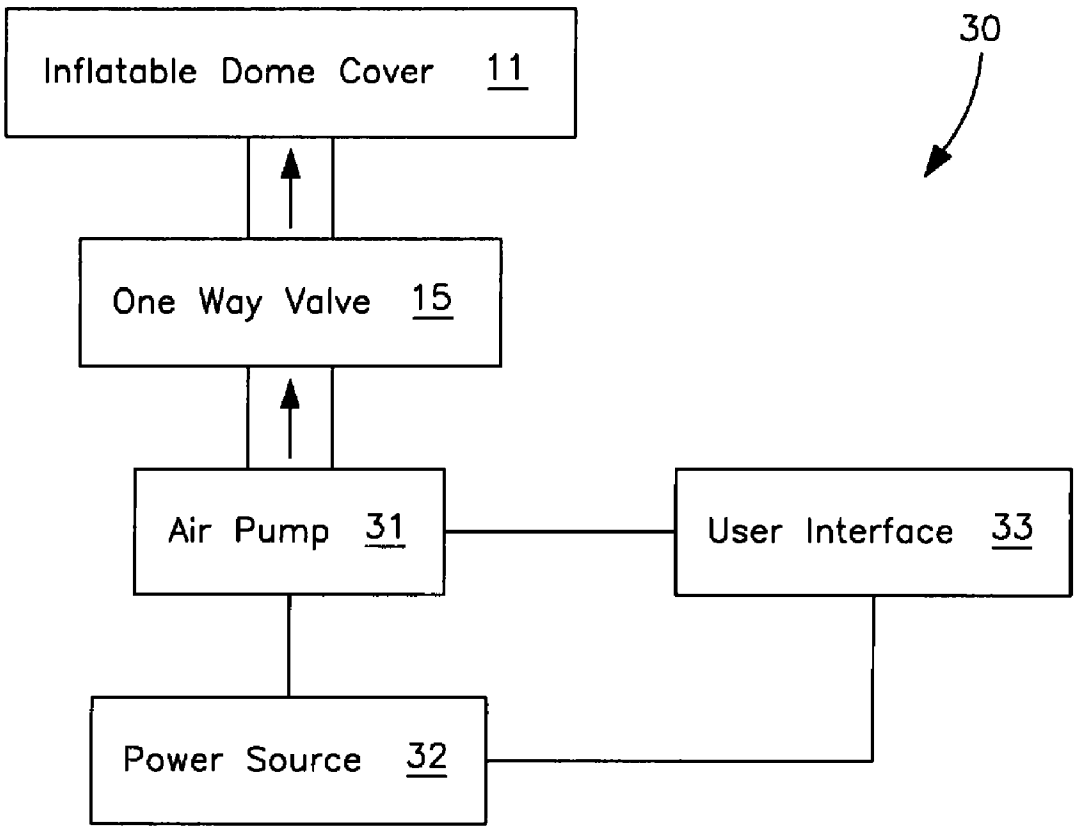
FIG. 4 is a high-level schematic block diagram showing the interrelationship between the major electronic components of the present invention.

In one embodiment, as perhaps best shown in FIG. 3, the bladder 17 preferably includes a main cavity 23 for receiving and holding air during when adapted to the inflated position. Such a bladder 17 further includes a plurality of walls 43 located inside the main cavity 23. The walls 43 are preferably configured in such a manner that a plurality of passageways 24, 25 are formed within the main cavity 23. Advantageously, each of the passageways 24, 25 are in fluid communication with the main cavity 23 such that air is selectively distributed through an entire surface area of the cavity 23 after entering the bladder 17 through the air valve 15.

In particular, a first one 24 of the passageways has a proximal end directly mated to the air valve 15. Such a first passageway 24 spans along an entire diameter of the bladder 17 and is provided with a plurality of apertures 26 channeling air towards the bottom 18 and top 19 regions of the bladder 17. A second one 25 of the passageways preferably has a proximal end directly mated to the bottom-most region 18 of the bladder 17. The second passageway 25 spans upwardly from the bottom-most region 18 and traverses the first passageway 24 such that the second passageway 25 terminates at the apex 21 of the bladder 17. The second passageway 25 is also provided with a plurality of apertures 27 that channel air towards and away from the air valve 15.

Notably, the first and second passageways 24, 25 are in fluid communication with each other and the air valve 15 respectively for evenly distributing air throughout the entire main cavity 23 during inflating procedures.

The present invention further includes a method of utilizing a protective pool covering system 10 for diverting undesirable debris and fluid away from a top surface of a pool 13. Such a method preferably includes the chronological steps of: providing and removably positioning an inflatable body 11 over the entire top surface of the pool 13. The body 11 includes a top most layer (liner) 16 formed from water impermeable material and spans over an entire surface area of the body 11. The top most layer 16 further has a flexible lip 12 continuously extending along an entire outer perimeter of the body 11 such that the lip 12 is adapted to be continuously abutted along an entire outer perimeter of the pool 13. An inflatable bladder 17 is formed from buoyant material and statically connected to the top most layer 16 and situated therebeneath. Thus, the body 11 is formed from buoyant material and adapted to float on the top surface of the pool 13 while disposed at the inflated position.

The method may further include the step of selectively inflating the body 11 with air such that the bladder 17 and the top most layer (liner) 16 are simultaneously inflated to a dome shape when the body 11 is adapted to an inflated position.

In another embodiment, use of the pool covering system would be very simple and straight forward. First, the user would purchase the system 10 in accordance to the size and shape of their swimming pool 13. After preparing their swimming pool 13 for the winter months by conditioning the water, the user would position the body 11 so that it rested directly above the pool 13, encompassing the top of the pool 13 completely, while the lip 12 of the unit would hang over the outer perimeter of the pool 13 and would be secured in place fastening members 20.

Next, using a household standard air pump 31, the user would fill the center, balloon-like bladder 17 of the body 11, thus inflating the unit. Once inflated, the convex dome would provide an impenetrable umbrella, completely shrouding the pool 13 while repelling debris, rainwater and snow. After proper installation, the pool covering system 10 would be left in place throughout the autumn, winter and early months of spring, protecting the pool 13 until the weather was warm enough to prepare the pool 13 for use. After use, the body 11 would be easily deflated, simply by opening the air valve 15, and the unit would be removed and stored away along with other pool accessories, until again needed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The system and use of the present invention are deemed readily apparent and obvious to one skilled in the art.

What is claimed as new and what is desired to secure by Letters Patent of the United States is:

1. A protective pool covering system for diverting undesirable debris and fluid away from a top surface of a pool, said protective pool covering system comprising: an inflatable body adapted to be removably positioned over the entire top surface of the pool, said body including a top most layer spanning over an entire surface area of said body, said top most layer further having a flexible lip continuously extending along an entire outer perimeter of said body such that said lip is adapted to be continuously abutted along an entire outer perimeter of the pool, and an inflatable bladder formed from buoyant material, said inflatable bladder being statically connected to said top most layer and situated therebeneath; and means for selectively inflating said body with air such that said bladder and said top most layer are simultaneously inflated to a dome shape when said body is adapted to an inflated position;

wherein said body is formed from buoyant material and adapted to float on the top surface of the pool while disposed at the inflated position;

wherein said bladder is dome shaped and occupies an entire volume of said body;

wherein said lip comprises: a plurality of fasteners spaced along an entire circumference thereof for maintaining said top most layer and said bladder at a substantially stable position during extended periods of time;

wherein a bottom-most region of said bladder is adapted to directly float on the top surface of the pool while a top-most region of said bladder remains elevated and thereby defines an apex of said bladder;

wherein body inflating means comprises an air valve directly connected to said top most layer and said bladder respectively, said air valve having a central orifice formed therein and passing through to an interior of said bladder;

an air pump communicatively coupled to said air valve;

a user interface communicatively coupled to said air pump; and a power source communicatively coupled to said user interface;

wherein said air pump is selectively adapted between alternate operating modes upon receiving a user input signal from said user interface;

wherein said bladder includes a main cavity for receiving and holding air during when adapted to the inflated position, said bladder further including a plurality of walls located inside said main cavity, said walls being configured in such a manner that a plurality of passageways are formed within said main cavity, each of said passageways being in fluid communication with said main cavity such that air is selectively distributed through an entire surface area of said cavity after entering said bladder through said air valve.

2. The protective pool covering system of claim 1, wherein a first one of said passageways has a proximal end directly mated to said air valve, said first passageway spanning along an entire diameter of said bladder and being provided with a plurality of apertures channeling air towards said bottom and top regions of said bladder.

3. The protective pool covering system of claim 2, wherein a second one of said passageways has a proximal end directly mated to said bottom-most region of said bladder, said second passageway spanning upwardly from said bottom-most region and traversing said first passageway such that said second passageway terminates at said apex of said bladder, said second passageway being provided with a plurality of apertures channeling air towards and away from said air valve.

4. The protective pool covering system of claim 3, wherein said first and second passageways are in fluid communication with each other and said air valve respectively.

5. A protective pool covering system for diverting undesirable debris and fluid away from a top surface of a pool, said protective pool covering system comprising: an inflatable body adapted to be removably positioned over the entire top surface of the pool, said body including a top most layer formed from water impermeable material and spanning over an entire surface area of said body, said top most layer further having a flexible lip continuously extending along an entire outer perimeter of said body such that said lip is adapted to be continuously abutted along an entire outer perimeter of the pool, and an inflatable bladder formed from buoyant material, said inflatable bladder being statically connected to said top most layer and situated therebeneath; and means for selectively inflating said body with air such that said bladder and said top most layer are simultaneously inflated to a dome shape when said body is adapted to an inflated position;

wherein said body is formed from buoyant material and adapted to float on the top surface of the pool while disposed at the inflated position;

wherein said bladder is dome shaped and occupies an entire volume of said body;

wherein said lip comprises: a plurality of fasteners spaced along an entire circumference thereof for maintaining said top most layer and said bladder at a substantially stable position during extended periods of time;

wherein a bottom-most region of said bladder is adapted to directly float on the top surface of the pool while a top-most region of said bladder remains elevated and thereby defines an apex of said bladder;

wherein a bottom-most region of said bladder is adapted to directly float on the top surface of the pool while a top-most region of said bladder remains elevated and thereby defines an apex of said bladder;

wherein body inflating means comprises an air valve directly connected to said top most layer and said bladder respectively, said air valve having a central orifice formed therein and passing through to an interior of said bladder;

an air pump communicatively coupled to said air valve;

a user interface communicatively coupled to said air pump; and a power source communicatively coupled to said user interface;

wherein said air pump is selectively adapted between alternate operating modes upon receiving a user input signal from said user interface;

wherein said bladder includes a main cavity for receiving and holding air during when adapted to the inflated position, said bladder further including a plurality of walls located inside said main cavity, said walls being configured in such a manner that a plurality of passageways are formed within said main cavity, each of said passageways being in fluid communication with said main cavity such that air is selectively distributed through an entire surface area of said cavity after entering said bladder through said air valve.

6. The protective pool covering system of claim 5, wherein a first one of said passageways has a proximal end directly mated to said air valve, said first passageway spanning along an entire diameter of said bladder and being provided with a plurality of apertures channeling air towards said bottom and top regions of said bladder.

7. The protective pool covering system of claim 6, wherein a second one of said passageways has a proximal end directly mated to said bottom-most region of said bladder, said second passageway spanning upwardly from said bottom-most region and traversing said first passageway such that said second passageway terminates at said apex of said bladder, said second passageway being provided with a plurality of apertures channeling air towards and away from said air valve.

8. The protective pool covering system of claim 7, wherein said first and second passageways are in fluid communication with each other and said air valve respectively.

* * * * *